US011574565B2

(12) United States Patent
Gislason

(10) Patent No.: US 11,574,565 B2
(45) Date of Patent: Feb. 7, 2023

(54) FLAG POLE MECHANISM

(71) Applicant: Reid Gislason, Winston, OR (US)

(72) Inventor: Reid Gislason, Winston, OR (US)

( * ) Notice: Subject to any disclaimer, the term of this patent is extended or adjusted under 35 U.S.C. 154(b) by 227 days.

(21) Appl. No.: 17/073,487

(22) Filed: Oct. 19, 2020

(65) Prior Publication Data

US 2021/0280102 A1 Sep. 9, 2021

Related U.S. Application Data

(60) Provisional application No. 62/986,826, filed on Mar. 9, 2020.

(51) Int. Cl.
*G09F 17/00* (2006.01)

(52) U.S. Cl.
CPC ..... *G09F 17/00* (2013.01); *G09F 2017/005* (2013.01); *G09F 2017/0025* (2013.01)

(58) Field of Classification Search
CPC ..... G09F 17/00; G09F 2017/0025; G09F 2017/005; G09F 2017/0008
See application file for complete search history.

(56) References Cited

U.S. PATENT DOCUMENTS 421,784 A * 2/1890 Tallman ..... G09F 17/00 116/173
1,610,663 A * 12/1926 Diago ..... E04H 12/32 116/173
2,225,103 A * 12/1940 Einermann ..... E04H 12/32 116/173
2,368,783 A * 2/1945 Schillinger ..... G09F 17/00 116/174
3,081,734 A * 3/1963 Spahl ..... G09F 17/00 116/173
3,595,202 A * 7/1971 Visitacion ..... G09F 17/00 52/146
3,777,428 A * 12/1973 Caufield ..... G08B 5/00 116/63 P
4,554,885 A * 11/1985 Burny, Jr. ..... G09F 17/00 116/174
4,791,878 A * 12/1988 Lewis ..... E04H 12/32 116/173
5,402,746 A * 4/1995 Deschamps ..... E04H 12/32 116/174
5,572,835 A * 11/1996 Atkins ..... G09F 17/00 248/407

(Continued)

FOREIGN PATENT DOCUMENTS

AT 393708 B * 12/1991
AT 411282 B * 10/2003 ..... G09F 17/00

(Continued)

*Primary Examiner* — Nimeshkumar D Patel
*Assistant Examiner* — Tania Courson
(74) *Attorney, Agent, or Firm* — Brennan, Manna & Diamond, LLC

(57) ABSTRACT

This present invention relates to a unique flag pole and flag hoisting system capable of displaying a fully-expanded flag despite the lack of wind, and features two hinge connected rods that attach to the top and side edge of a flag, and utilizes a pulley system to expand and secure the flag in place. The system is adjustable to half-mast or any other height along the flag pole as desired, and offers a simple, convenient, and effective method of displaying any type of flag.

19 Claims, 5 Drawing Sheets

(56) References Cited

U.S. PATENT DOCUMENTS

| | | | | |
|---|---|---|---|---|
| 6,758,159 | B2 * | 7/2004 | McCudden | G09F 17/00 248/329 |
| 6,923,141 | B1 * | 8/2005 | Staats | G09F 17/00 116/173 |
| 8,191,497 | B2 * | 6/2012 | McCudden | G09F 17/00 116/173 |
| 8,881,669 | B2 * | 11/2014 | Horvath | G09F 17/00 116/174 |
| 9,177,494 | B2 * | 11/2015 | Shapiro | G09F 17/00 |
| 2008/0092799 | A1 * | 4/2008 | Evans | G09F 17/00 116/174 |
| 2010/0101479 | A1 * | 4/2010 | Grahl | E04H 12/32 116/173 |
| 2012/0111259 | A1 * | 5/2012 | Swisher | G09F 17/00 116/173 |
| 2019/0251880 | A1 * | 8/2019 | Klevana | G09F 17/00 |

FOREIGN PATENT DOCUMENTS

| | | | | |
|---|---|---|---|---|
| DE | 10311703 | A1 * | 10/2003 | G09F 17/00 |
| GB | 2306982 | A * | 5/1997 | E04H 12/32 |
| WO | WO-2006007737 | A1 * | 1/2006 | E04H 12/32 |
| WO | WO-2006039925 | A1 * | 4/2006 | G09F 17/00 |
| WO | WO-2020264245 | A1 * | 12/2020 | |

* cited by examiner

FLAG POLE MECHANISM

CROSS-REFERENCE TO RELATED APPLICATION

The present application claims priority to, and the benefit of, U.S. Provisional Application No. 62/986,826, which was filed on Mar. 9, 2020 and is incorporated herein by reference in its entirety.

FIELD OF THE INVENTION

The present invention relates generally to the field of flag poles designed to support and expand one or more flags. More specifically, the present invention relates to a novel flag pole mechanism capable of displaying a fully-expanded flag despite the lack of wind. Accordingly, this disclosure makes specific reference thereto. Nonetheless, it is to be appreciated that aspects of the present invention are also equally applicable to other like applications, devices and methods of manufacture.

BACKGROUND OF THE INVENTION

By way of background, a flag pole is used to hang banners, flags, pennants, advertising collateral and other decorative memorabilia. A standard flag pole supports a flag or banner effectively only when a wind blows at a sufficient speed, thereby causing the flag to be unfurled. Otherwise, the flag remains furled or flaccid and hangs next to flag pole. Stated differently, when the wind does not blow at a sufficient speed to unfurl the flag, the flag remains draped over or lying against the flag pole making it difficult to see. A flag or banner is ideally presented when it is seen in its full appearance, extended out from the flag pole and typically displayed perpendicular or at a 90 degree angle to the flag pole so that the complete extent of the flag or banner may be witnessed by those in the viewing area.

In general, national flags symbolize national pride, and are hoisted on the flag poles of various households, government and private offices, retail locations, parks, roadsides, military bases, gravesites, etc. to show and encourage patriotism and exhibit one's pride in his or her country. Oftentimes, people are disappointed when their national flag is not shown in its best light and/or does not stand out from the flag pole.

Another limitation of existing flag poles is that once a flag supported therefrom becomes wrapped around the flag pole (e.g., because of the wind), the flag tends to remain in this state even if the wind re-emerges. In fact, more often than not, the tangled or wrapped flag remains in this state until the owner or caretaker notices the problem, and then takes the time to correct it by moving the cordage used to raise and lower the flag so that the flag is released from the pole. Alternatively, the tangled or wrapped flag problem may force the owner or caretaker to have to take the flag down, untangle it, and then hoist the flag up the flag pole again. Once the problem resurfaces, the entire process may need to be repeated again.

Therefore, there exists a long felt need in the art for an improved flag pole mechanism for displaying flags, banners, pennants, advertising collateral, or other celebratory memorabilia such that a fully-expanded or unfurled flag is always shown, despite the lack of wind to drive the waving of the flag or banner. There is also a long felt need in the art for an improved flag pole mechanism for displaying flags that maintains the flag, banner, pennant, etc. in the desired position of standing outwardly from the flag pole at approximately a 90-degree angle. Furthermore, there is also a long felt need in the art for an improved flag pole mechanism that enables easy adjustment of the flag to a desired height, such as half-staff or mast or full summit, without causing the flag to become furled or flaccid against the flag pole. Additionally, there is a long felt need in the art for an improved flag pole mechanism that allows the flag to rotate fully about the flag pole so that the flag or banner does not become entangled or wrapped around the flag pole while being displayed in windy conditions or other inclement weather. Finally, there is a long felt need in the art for an improved flag pole mechanism that is relatively inexpensive to manufacture, and that is both safe and easy to use.

The subject matter disclosed and claimed herein, in one embodiment thereof, comprises a flag pole mechanism for flying a flag, banner, pennant or the like and having a first hinged rod or arm attached to a side of the flag, and a second hinged rod or arm attached to the top of the flag through one or more clips. Each of the first hinged rod and the second hinged rod are connected to a pulley with an attached rope. Further, the second hinged rod is pivotally hinged to the first hinged rod, and is repositionable between a first position and a second position relative to the first hinged rod. When the rope is pulled in a downward direction (i.e., in the direction of the user or the ground), the second hinged rod is moved into the second position, where it is roughly perpendicular to the first hinged rod and the flag is fully unfurled, regardless of the presence of wind. Likewise when the rope is released, the second hinged rod rotates back to the first position where it is substantially parallel to the first hinged rod and the flag is again furled or flaccid.

In this manner, the novel flag pole mechanism of the present invention accomplishes all of the forgoing objectives, and provides a relatively safe, easy, convenient and cost-effective solution to fully expand and display a flag even when there is little to no wind. The novel flag pole mechanism of the present invention also ensures that the flag will not become tangled or wrapped around the flag pole.

SUMMARY

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a flag display system having a first hinged arm to support an edge of a flag through a fastening mechanism, and a second hinged arm to support the top of the flag through a similar fastening mechanism. The first and second hinged arms are pivotally attached to one another, and connected to a rope driven pulley system. More specifically, the rope is tied to a distal end of the second hinged arm such that when the rope is pulled downwardly, the second hinged rod is pivotally repositioned to the second position, where it is roughly perpendicular to the first hinged arm and the flag is completely unfurled regardless of the presence of wind or the lack thereof. The first hinged arm may be attached to flag pole through any suitable fastening mechanism, such as Velcro®, a strap, chain, clamps or the like so that the flag display system remains secured to the flag pole at all times, including during high winds or other inclement weather. Each of the first and second hinged arms are substantially straight and cylindrical, and comprise a plurality of clips or pull ties for attaching the flag thereto in such a manner that, when the second hinged arm is in the second position (i.e., roughly perpendicular to the first arm), the flag is always fully extended and displayed along the second hinged arm. The first and second hinged arms may be permanently or removably attached to the each other.

In a further embodiment of the present invention, an improved flag pole designed to continuously display a fully extended and unfurled flag is disclosed and comprises a first hinged arm attached to the flag pole through a fastening mechanism that also supports a side edge of a flag. A second hinged arm is pivotally attached to one end of the first hinged arm, and supports the top edge of the flag along its entire length. The second hinged rod is also repositionable between a first position and a second position, and has hooks/clips positioned along its length in spaced apart fashion. A rope and pulley system is used to reposition the second hinged arm between the first and second positions. More specifically, the rope passes through a first pulley system which enables the second hinged rod to rotate about its hinged connection with the first hinged arm and into the second position when the rope is pulled, where it is roughly perpendicular to the first hinged arm. In an alternative embodiment, a second pulley system may be positioned atop the flag pole and function in a similar manner.

In a further embodiment of the present invention, a method of hoisting a flag in an extended manner and on full display is disclosed. The method comprises the initial step of providing a flag pole mechanism for flying a flag, banner, pennant or the like and having a first hinged rod or arm attached to a side of the flag, a second hinged rod or arm attached to the top of the flag through one or more clips, a rope and a pulley system. Each of the first hinged rod and the second hinged rod are connected to a pulley with an attached rope. The second hinged rod is pivotally hinged to the first hinged rod, and is repositionable between a first position and a second position relative to the first hinged rod. Next, a rope and pulley system is used to raise the flag pole mechanism with the flag attached thereto to a desired height along the flag pole. Then the rope and pulley system is used to reposition the second hinged arm into a second position, where it is substantially perpendicular to the first hinged arm, and wherein the flag is fully extended and unfurled, regardless of the presence of wind.

In yet a still further exemplary embodiment of the presently described invention, a dual flag display system is presented and includes a flag pole for displaying two flags, the flag pole having a length, a top end and a bottom end. Each of the two flags are substantially rectangular in shape (though they need not be) and are comprised of first and second end edges, and first and second sides. The dual flag presentation system is further comprised of first and second bracket systems (i.e., one for supporting each of the two flags), wherein each of the first and second bracket systems is comprised of a first arm, a second arm, a plurality of clips for supporting and holding a flag, a rope and a pulley. Each of the first and second arms are hingedly attached to one another such that the second arm is repositionable between a first or closed position and a second or open position. More specifically, the rope and pulley system to reposition the second hinged arm into the second or open position where it is substantially perpendicular to the first arm, and wherein the flag supported thereby is fully extended and unfurled, regardless of the presence of wind.

The system of the present invention is particularly advantageous as it enables a user to fly a flag fully unfurled, regardless of wind conditions. The system of the present invention allows the flag(s) supported thereby to rotate fully around the flag pole through the pulley system, without wrapping around the flag pole and/or becoming tangled on the flag pole.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
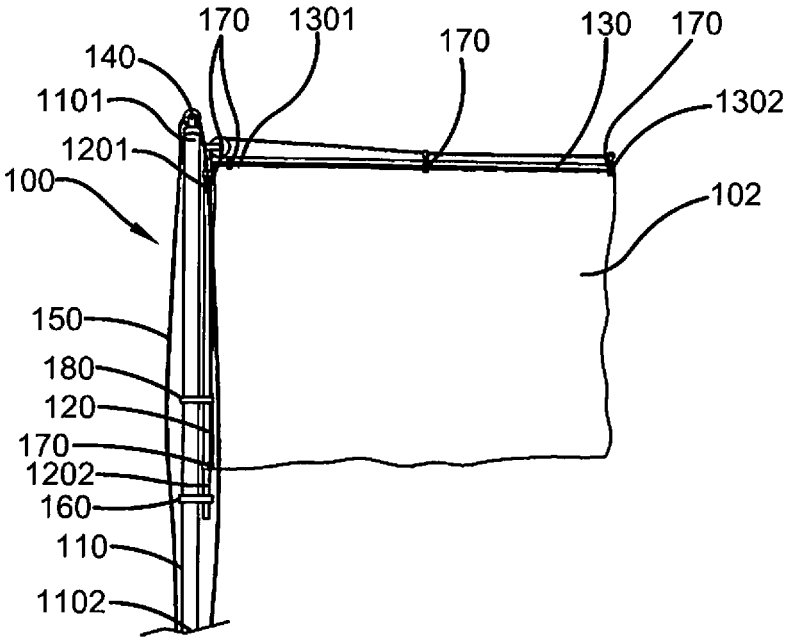
FIG. 1 illustrates a perspective view of one potential embodiment of the flag pole mechanism of the present invention fully deployed and supporting a flag in an unfurled condition in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a flag pole mechanism for displaying flags, banners, pennants, advertising collateral, or other celebratory memorabilia such that a fully-expanded or unfurled flag is always shown, regardless of the presence of wind or the lack thereof. Further, there is also a long felt need in the art for a flag pole mechanism for displaying flags that maintains the flag, banner, pennant, etc. in the desired position of standing outwardly from the flag pole at an approximate 90-degree angle. There is also a long felt need in the art for a flag pole mechanism that enables a user to easily adjust the height of the flag, without causing the flag to become furled or flaccid against the flag pole. Additionally, there is a long felt need in the art for a flag pole mechanism that allows the flag to rotate fully about the flag pole so that the flag or banner does not become entangled or wrapped around the flag pole while being displayed in windy conditions or other inclement weather. Finally, there is a long felt need in the art for a flag pole mechanism that is relatively inexpensive to manufacture, and that is both safe and easy to use.

The present invention, in one exemplary embodiment, is a novel flag pole mechanism that is capable of displaying a fully-extended flag despite the lack of wind. The flag pole mechanism of the present invention is comprised of a rope, a pulley system, a first rod that is attached to a side of a flag, and a second rod that is attached to the top of the same flag. The second rod is hingedly attached to an end of the first rod to form a pivot point about which the second rod may be rotated about between a first position and a second position is which the second rod is roughly perpendicular to the first rod. The rope and pulley system is used to raise and lower the first and second rods relative to the flag pole, and to reposition the second rod between the first and second positions. When the second rod is in the second position, the flag attached thereto is fully extended and unfurled, regardless of wind conditions.

Referring initially to the drawings, FIG. 1 illustrates a perspective view of one potential embodiment of the flag pole mechanism or system 100 of the present invention fully deployed and supporting a flag 102 in an unfurled condition in accordance with the disclosed architecture. The flag pole mechanism 100 of the present invention is removably and repositionably attached to a stationary flag pole 110, and enables a flag 102 to fly in an expanded manner and with full visibility. More specifically, the first hinged arm 120 is removably tied to the flag pole 110 using a band, snap lock or Velcro® type fastening mechanism 160 and through a chain 180.

The flag pole system 100 is comprised of a first hinged arm 120 to support an edge of the flag 102 via a plurality of clips 170, a second hinged arm 130 to support the top of the flag 102 through the clips 170. The first hinged arm 120 and the second hinged arm 130 are pivotally hinged at a proximal end 1201 of the first hinged arm 120 and a proximal end 1301 of the second hinged arm 130. Each of the first and second hinged arms 120, 130 are further attached to a pulley system 140 and a rope 150. More specifically, the rope 150 is connected to the distal end 1302 of the second hinged arm 130 and passes through the pulley system 140 and runs along the flag pole 110 to the bottom 1102 of the flag pole 110, where it may be removably attached to a cleat 700 present near the bottom portion 1102 of the pole 110 and used for securing the excess rope 150 to the flag pole 110. The rope 150 passes through the two pulleys 1401, 1402 present in the pulley system 140 as further described below. Additionally, to stabilize the first hinged arm 120, the first hinged arm 120 is removably and repositionably attached to the flag pole 110 (i.e., so that it may travel along the length or height of the pole 110) using a band, snap lock, Velcro® type fastening mechanism 160, chain 180 or other suitable securing mechanism.

When the rope 150 passing through the pulley wheel 1401 present at the top of the flag pole 110 is pulled, the pulley wheel 1402 present at the hinge connecting the hinged arms 120, 130 is pulled upwardly (i.e., in the direction of the top end 1101 of the flag pole 110), and the hinged arms 120, 130 and the attached flag 102 are repositioned upwardly in the direction of the top end 1101 of the flag pole 110. Once the hinged arms 120, 130 and the attached pulley 140 reach the top end 1101 of the flag pole 110 (or at any other selected height), the part of the rope 150 coming down from the pulley wheel 1402 connected to the hinged arms 120, 130 is pulled downwardly (i.e., in the direction of the ground or the cleat). Doing so, in turn, causes the second hinged arm 130 supporting the top end of the flag 102 via clips 170 to reposition or rotate about the hinge, and into the second or opened position where it is substantially perpendicular to the first hinged arm 120. Once the second hinged arm is in the second position, the flag 102 is completely and fully extended and visible even if there is no or insufficient wind to support the same.

The use of a single rope or halyard line 150 passing through the pulley system 140 and tied to a distal end of the second hinged arm 130 makes the flag pole mechanism 100 of the present invention easy to install and use. Further, the flag pole mechanism 100 may be used with newly manufactured flag poles 110, or for retrofitting existing flag poles 110 with little or no modification to the flag pole 110. Further, the flag 102 is completely supported by the second hinged arm 130, which does not allow the flag 102 to drape downwardly or wrap around the flag pole 110. Additionally, the flag pole mechanism 100 of the present invention may also be used to support banners, pennants, memorabilia and advertisements designed for sales promotions, warnings, greetings or any other message or information. The hinged arms 120, 130 may be repositioned with minimal effort, thereby make the flag pole mechanism 100 suitable for use by the young and elderly alike, or by folks with a disability.

Figure 2:
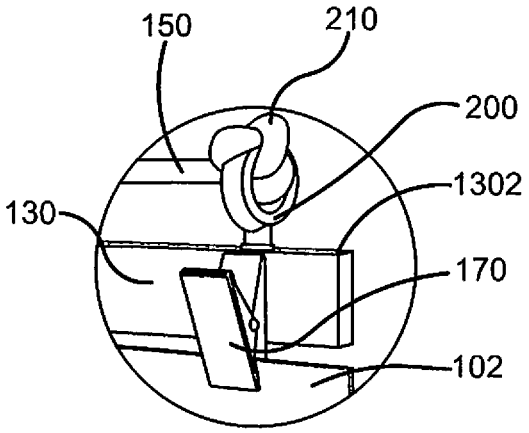
FIG. 2 illustrates a perspective close up view of one potential embodiment of the fastening mechanism on a distal end of the second arm of the flag pole mechanism of the present invention in accordance with the disclosed architecture.

FIG. 2 illustrates a perspective close up view of one potential embodiment of a fastening mechanism positioned on a distal end of the second arm of the flag pole mechanism 100 of the present invention to secure one end of the rope 150 to the second arm 130 in accordance with the disclosed architecture. More specifically, one end of the rope 150 is attached to a loop holder 200 present at the distal end 1302 of the second hinged arm 130 by tying a knot 210. Similarly, the rope 150 may be tied at more than one position on the second hinged arm 130 via a knot 210 or any other suitable attachment means. FIG. 2 also illustrates the flag 102 being attached to the second arm 130 by a simple fastening mechanism, such as a clip 170 which may be attached to, or integrally formed with, the second hinged arm 130 through an adhesive or any other similar mechanism. In a preferred embodiment, a plurality of spaced apart clips 170 are positioned along the length of second arm 130 (which should be at least as long as a fully extended flag 102) and are used to support the top end of the flag 102. The clips 170 should have a strong enough clamping strength to support the flag 102, even in adverse weather conditions and high winds. The clips 170 may be manufactured from any suitable material such as, but not limited to, an aluminum, alloy, plastic or the like, provided that the same is relatively anti-corrosive, lightweight and durable. In addition, the clips 170 may be repositionable along the second arm 130 so that they are capable of being adjusted to accommodate and support various shapes and sizes of flags 102, banners, pennants, and the like.

Figure 3:
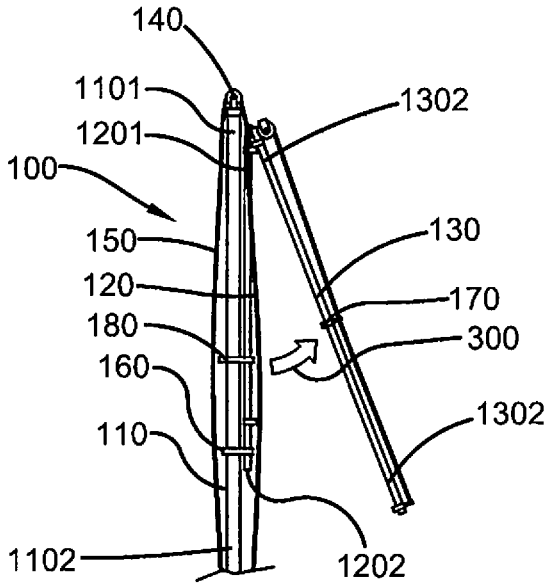
FIG. 3 illustrates a perspective view of one potential embodiment of the flag pole mechanism of the present invention attached to a flag pole and in a partially deployed position in accordance with the disclosed architecture.

FIG. 3 illustrates a perspective view of one potential embodiment of the flag pole mechanism 100 of the present invention attached to a flag pole 110 and in a partially deployed position in accordance with the disclosed architecture. More specifically, the second hinged arm 130 may be repositioned between a first position and a second position by pulling or releasing the rope 150 passing through the pulley system 140. For example, when the rope 150 is pulled downwardly, the second hinged arm 130 is rotated upwardly about the hinge point and away from the first arm 120 until it is at an angle 300 that is approximately 90 degrees (or perpendicular) with respect to the first arm 120. Similarly, when the tension on the rope 150 is released, the weight of the cantilevered second arm 130 will rotate downwardly until it is substantially parallel and adjacent to the first arm 120, which is also referred to as its first position. The second rod or arm 130 may also have a plurality of intermediate positions between the first and second position, wherein, for example, the angle 300 between the second arm 130 and the first arm 120 is less than 45 degrees, as best shown in FIG. 3. Additionally, as previously explained, the rope 150 and pulley system 140 may also be used to adjust the height of the entire flag pole mechanism 100 relative to the flag pole 110 so that, for example, the flag 102 supported by the system 100 may be flown at full mast (i.e., near the top end 1101 of the flag pole 110), at a half mast position, or any other position along the flag pole 110.

Figure 4:
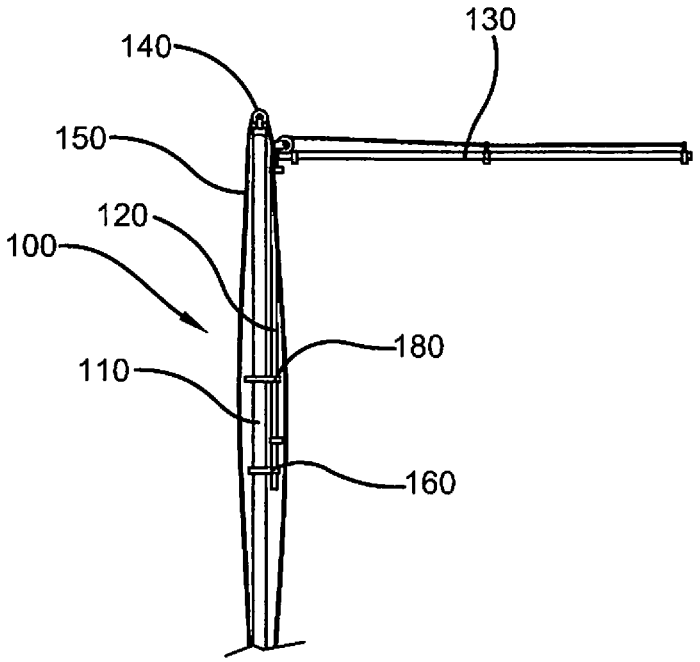
FIG. 4 illustrates a perspective view of one potential embodiment of the flag pole mechanism of the present invention attached to a flag pole and in a fully deployed or open position in accordance with the disclosed architecture, wherein the second arm is approximately perpendicular to the first arm.

FIG. 4 illustrates a perspective view of one potential embodiment of the flag pole mechanism 100 of the present invention attached to a flag pole 110 and in a fully deployed or open position in accordance with the disclosed architecture, wherein the second arm 130 is approximately perpendicular to the first arm 120. More specifically, the second hinged rod 130 is now in what is referred to herein as the second position, which is generally parallel to the ground and wherein the angle 300 is now approximately 90 degrees. In the second position, the flag 102 that is attached to the first hinged arm 120 and the second hinged arm 130 is fully expanded and visible even when there is no or insufficient wind to otherwise support the same. The first and second arms 120, 130 may also facilitate and support a non-rectangular flag such as, without limitation, a square, triangular, circular, hexagonal, pentagonal or trapezoidal flag.

The hinged arms 120, 130 may be comprised of any suitable and weather resistant material including, without limitation, aluminum, gel-coated fiberglass, rigid plastic material, steel, etc., and may be manufactured in a variety of colors, cross-sections, etc. The flag pole 110 may be comprised of similar materials and/or cross sections, and may have a height in the range of about 3 meters to 40 meters, though the same should not be construed as a limitation and the height of flag pole 110 may be any height that suits user need and/or preference. The rope or halyard line 150 may be of a nylon, polyester, cotton blend, polyester with wire core, or any other similar material, provided the same is weather resistant. Additionally, the rope 150 should have a length in accordance with the height of the flag pole 110 and the length of the second hinged arm 130. For example, the length of the rope 150 is preferably less than three times the sum of the above ground height of the flag pole 110 and the length of the second arm 130 to provide the user with enough slack to create knots at the loop holes as needed, remove a worn out section of the rope without having to replace the entire rope, and/or wrap the excess rope 150 around the cleat 700.

Figure 5C:
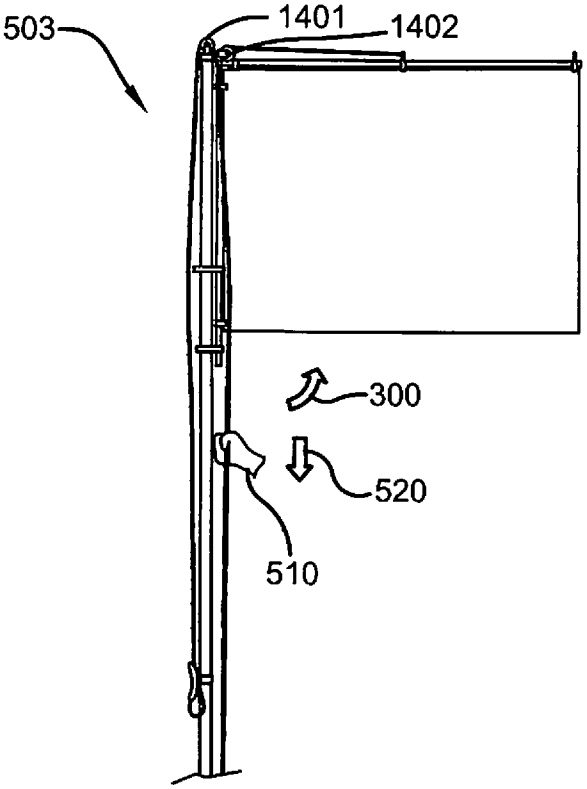
FIG. 5C illustrates a perspective view of one potential embodiment of the flag pole mechanism of the present invention fully deployed and supporting a flag in an unfurled condition in accordance with the disclosed architecture.
Figure 5B:
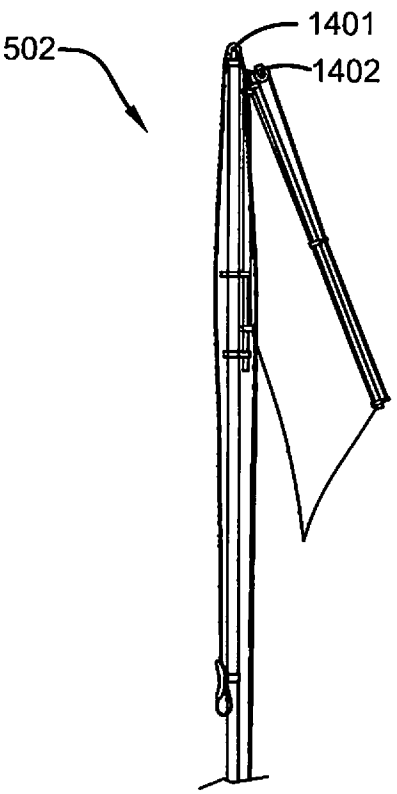
FIG. 5B illustrates a perspective view of one potential embodiment of the flag pole mechanism of the present invention partially deployed and supporting a flag in accordance with the disclosed architecture.
Figure 5A:
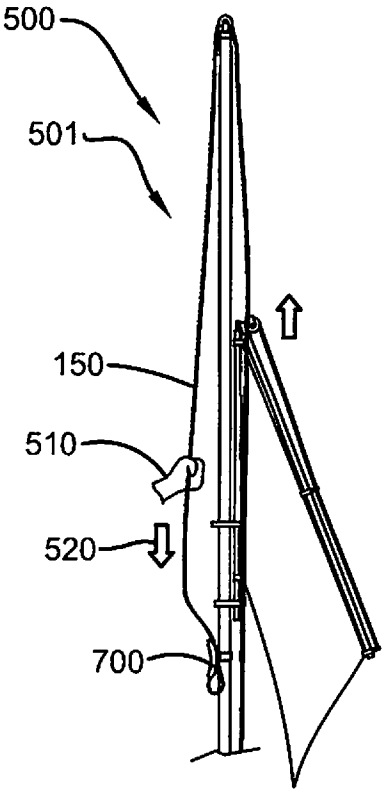
FIG. 5A illustrates a perspective view of one potential embodiment of the flag pole mechanism of the present invention in an undeployed position in accordance with the disclosed architecture.

FIGS. 5A, B and C illustrates a graphical representation of one method of repositioning a flag 102 from a stowed position to a fully deployed and unfurled position using one potential embodiment of the flag pole mechanism 100 of the present invention in accordance with the disclosed architecture. More specifically, initially at 501, the rope 150 is routed through the pulley wheel 1401 and is secured to the cleat 700 by a user 510. Accordingly, the pulley wheel 1402 and the hinged rods 120, 130 are pulled upwardly in a direction 530, and the second hinged rod 130 is also moved slightly outwardly from the first rod 120 at the same time to an angle 300 of less than 45 degrees and preferably around 15 to 30 degrees. At step 502, the pulley wheel 1402 and the hinged rods 120, 130 are positioned at a desired position, for example, at the summit of the flag pole 110, or alternatively at the half mast or half-staff position. Then, at step 503, the user 510 pulls the portion of the rope 150 which passes through the pulley wheel 1402 and is tied to the distal part of the second hinged rod 130 in a downward direction 520. The force enables the second hinged arm 130 that supports the top end of the flag 102 through clips 170 to extend and rise up, such that the angle between the second hinged arm 130 and the first arm 120 is approximately 90-degrees. In this position, also referred to herein as the second position, the flag 102 is completely or fully extended and visible even if there is no or insufficient wind to support the same. Additionally, the first arm 120 remains stable and balanced and connected to the flag pole 110 such that the edge of the flag 102 supported by the first arm 120 remains stable, and the top end of the flag 102 supported by the second hinged arm makes the flag 102 stable and fully extended.

Figure 6:
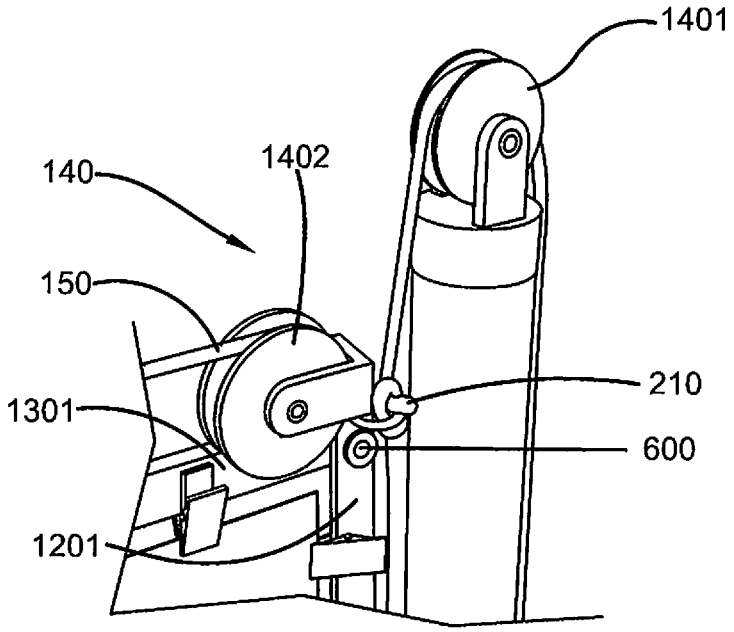
FIG. 6 illustrates a perspective close up view of one potential embodiment of the pulley systems of the flag pole mechanism of the present invention in accordance with the disclosed architecture.

FIG. 6 illustrates a perspective close up view of one potential embodiment of the pulley system 140 of the flag pole mechanism 100 of the present invention in accordance with the disclosed architecture. More specifically, the rope 150 is fixedly attached to a distal end of the second hinged arm 130 and then passes through the pulley wheel 402 that is placed near the proximal end 1301 of the second hinged arm 130 and proximal end 1201 of the first hinged arm 120. The rope 150 then extends through a second pulley wheel 1402, and travels along a length of the flag pole 110 where it may be secured to a cleat 700 fixedly attached to the flag pole 100 at a location or height that is easily accessible to a user. The rope 150 may further comprise a knot 210 adjacent to the hinged mechanism 600 that makes a strong fastening mechanism for the rope such that the second pulley wheel 1402 moves smoothly in a vertical direction along the length of the flag pole 110, and does not slip beyond the knotted location.

Figure 7:
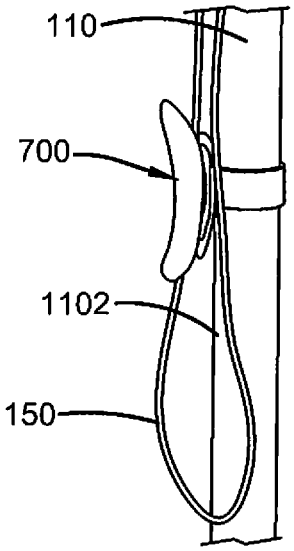
FIG. 7 illustrates a perspective close up view of one potential embodiment of the cleat that may be used to secure the rope of the flag pole mechanism of the present invention in accordance with the disclosed architecture.

FIG. 7 illustrates a perspective close up view of one potential embodiment of the cleat 700 that may be used to secure the rope 150 of the flag pole mechanism 100 of the present invention in accordance with the disclosed architecture. More specifically, the cleat 700 secures the rope 150 to the flag pole 110 when not in use. The cleat 700 may be screwed or bolted near the bottom end 1102 of the flag pole 110 so that it is easily accessible by a user, such as someone with a disability or that is in a wheelchair. The cleat 700 may be made up of bronze, aluminum, plastic or any other similar material which is not subject to deterioration by exposure to the elements.

Figure 8:
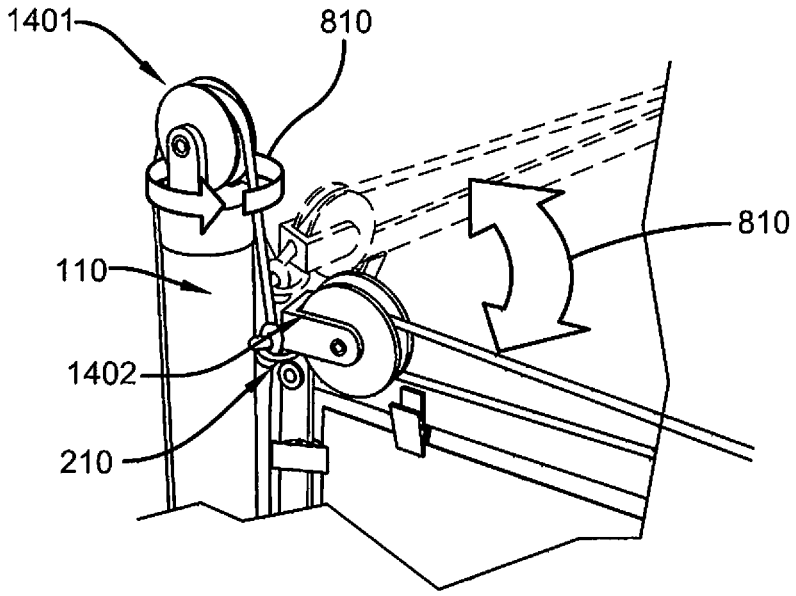
FIG. 8 illustrates a perspective close up view of one potential embodiment of the pulley systems of the flag pole mechanism of the present invention in accordance with the disclosed architecture, where the pulley system is 360 degrees rotatable about the flag pole.

FIG. 8 illustrates a perspective close up view of one potential embodiment of the pulley system 140 of the flag pole mechanism 100 of the present invention in accordance with the disclosed architecture, where the pulley system 140 is 360 degrees rotatable about the longitudinal axis of the flag pole 110. More specifically, the first pulley wheel 1401 is rotatable 360 degrees atop of the flag pole 110. Further, when the first pulley 1401 rotates, for example, in a clockwise direction 810, the second pulley 1402 moves in the same direction 810 along the circumference of the flag pole 110. In this manner, the pulley system 140 of the present invention allows the flag 102 to rotate fully about the flag pole 110 without wrapping around, or becoming entangled with, the flag pole 110.

Figure 9:
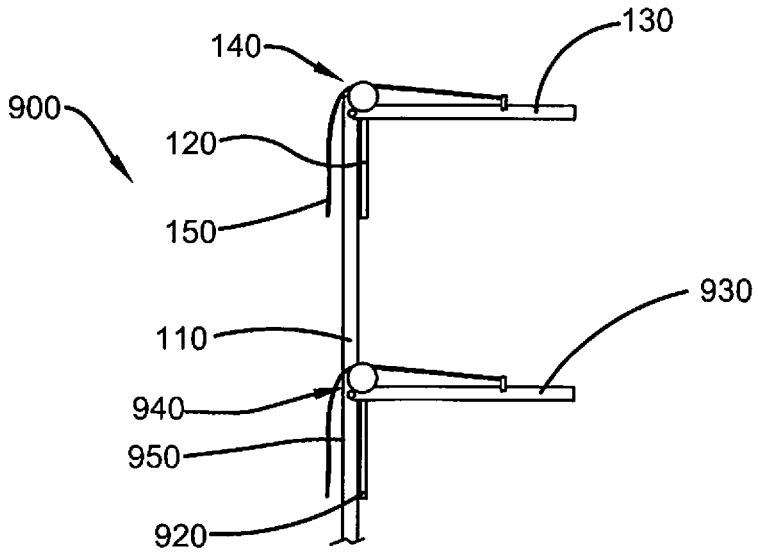
FIG. 9 illustrates a perspective view of a two flag pole mechanism of the present invention removably attached to a single flag pole in a stacked fashion and in accordance with the disclosed architecture.

FIG. 9 illustrates a perspective view of a two flag pole mechanism 900 of the present invention removably attached to a single flag pole 110 in a stacked fashion and in accordance with the disclosed architecture. More specifically, the two flag pole mechanism 900 may be used to support two separate flags 102, each at a different height. For example, the flag 102 positioned at the higher height may be the national flag of a country, and the second lower flag 102 may be a state or provincial flag, team flag, political flag, etc. As best shown in FIG. 9, the dual flag hoisting system 900 is comprised of a first flag pole mechanism 100 that may be in the form of any of the embodiments described herein and a second, separate and identical flag pole mechanism comprised of a first hinged arm 920, a second hinged arm 930, a pulley mechanism 940, and a rope 950, wherein the flag 102 is supported by the first hinged arm 920 and the second hinged arm 930 in the same manner as described above. Additionally, the pulley mechanism 940 operates in the same manner described above with respect to the pulley mechanism 140 with the rope 950 being pulled down to raise the second hinged rod 930 to form a 90-degree angle with the first arm 920 and fully display the flag 102.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "improved flag hoisting system", "flag hoisting system with pole", "flag hoisting system", and "improved flag pole", are interchangeable and refer to the flag pole mechanism 100 of the present invention.

Notwithstanding the forgoing, the flag pole mechanism 100 of the present invention and its various components can be of any suitable size and configuration as is known in the art without affecting the overall concept of the invention, provided that they accomplish the above stated objectives. One of ordinary skill in the art will appreciate that the size, configuration and material of the flag pole mechanism 100 as shown in the FIGS. are for illustrative purposes only, and that many other sizes and shapes of the flag pole mechanism 100 and its various components are well within the scope of the present disclosure. Although the dimensions of the flag pole mechanism 100 and its components are important design parameters for user convenience, the flag pole mechanism 100 and its various components may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A flag hoisting system comprising:

a flag pole for displaying a flag, wherein the flag pole is comprised of a length, a top end and a lower end, and the flag is comprised of a first end edge, a second end edge, a first side and a second side;

a first arm positioned adjacent to the flag pole, wherein the first arm is comprised of at least one fastener for attaching the flag to the first arm;

a second arm movable from a first position substantially parallel with the first arm to a second position substantially perpendicular to the first arm and comprising at least one clip for attaching the flag to the second arm;

a rope;

a first pulley provided at a top of the flag pole; and a second pulley used to reposition the second arm between the first position and the second position; and wherein the first arm and second arm are connected to one another via a hinge.

2. The flag hoisting system as recited in claim 1, wherein the rope extends generally along the length of the flag pole and is removably attached to a cleat disposed toward the lower end of the flag pole when the rope is not in use.

3. The flag hoisting system as recited in claim 1, wherein the second arm is pivotable from the first arm at the hinge.

4. The flag hoisting system as recited in claim 1, wherein the second pulley enables the second arm to be repositioned to a 90-degree angle from the first arm.

5. The flag hoisting system as recited in claim 1, wherein the second arm comprises a plurality of clips that are repositionable along a length of the second arm.

6. The flag hoisting system as recited in claim 1, wherein the first arm comprises a plurality of fasteners that are repositionable along a length of the first arm.

7. The flag hoisting system as recited in claim 1, wherein each of the first arm and the second arm are repositionable along the length of the flag pole.

8. The flag hoisting system as recited in claim 1, wherein the second arm is comprised of a loop holder positioned on a distal end of the second arm for securing the rope and to facilitate a movement of the second arm proximate to the first arm.

9. The flag hoisting system as recited in claim 8, wherein the first pulley is rotatable 360 degrees about a longitudinal axis of the flag pole.

10. A bracket system for use with a flag pole, the bracket system comprising:

a first arm; and a second arm pivotally attached to an end of the first arm at a hinge, wherein each of the first and second arms are comprised of a plurality of clips that are repositionable along each of the first and second arms to support one of a flag, a banner, a pennant, an advertising media, a memorabilia or a combination thereof, and further wherein the second arm is repositionable between a vertical position and a horizontal position.

11. The bracket system as recited in claim 10 further comprising a rope and a pulley positioned adjacent to the hinge, wherein the rope and the pulley are used to reposition the second arm between the vertical and horizontal positions.

12. The bracket system as recited in claim 10, wherein the second arm is substantially perpendicular to the first arm when in the horizontal position.

13. The bracket system as recited in claim 10, wherein the second arm is substantially parallel to the first arm when in the vertical position.

14. The bracket system as recited in claim 10, wherein the bracket system is removably attached to and repositionable about a length of the flag pole.

15. The bracket system as recited in claim 10, wherein the second arm is comprised of a loop holder positioned on a distal end of the second arm for securing the rope and to facilitate a movement of the second arm proximate to the first arm.

16. A dual flag presentation system comprising;

a flag pole for simultaneously displaying a first flag and a second flag, wherein the flag pole is comprised of a length, a top end and a lower end;

a first bracket systems comprised of a first arm and a second arm pivotally attached via a hinge to an end of the first arm, wherein each of the first arm and the second arm are comprised of at least one clip attached to the first flag;

a second bracket system comprised of a first rod and a second rod pivotally attached via a hinge to an end of the first rod, wherein each of the first rod and the second rod are comprised of at least one fastener attachable to the second flag;

a rope; and a pulley system.

17. The dual flag presentation system as recited in claim 16, wherein the pulley system is comprised of a first pulley mounted on a top of the flag pole, a second pulley mounted adjacent to an intersection of the first arm and second arm, and a third pulley mounted adjacent to an intersection of the first rod and the second rod.

18. The dual flag presentation system as recited in claim 16, wherein of the second arm and the second rod are repositionable between a first position and a second position.

19. The dual flag presentation system as recited in claim 18, wherein, when in the second position, each of the second arm and the second rod is substantially perpendicular to each of the first arm and the first rod.

* * * * *